United States Patent [19]

Norton

[11] Patent Number: 4,559,722

[45] Date of Patent: Dec. 24, 1985

[54] CONSTRUCTION OF UPPER FOR ATHLETIC SHOE

[75] Inventor: Edward J. Norton, Ipswich, Mass.

[73] Assignee: New Balance Athletic Shoe, Inc., Lawrence, Mass.

[21] Appl. No.: 542,027

[22] Filed: Oct. 14, 1983

[51] Int. Cl.[4] ..... A43B 5/00; A43B 19/00

[52] U.S. Cl. ..... 36/89; 36/105; 36/114; 36/69

[58] Field of Search ..... 36/89, 114, 129, 45, 36/68, 69, 128, 71, 32 R, 126, 105

[56] References Cited

U.S. PATENT DOCUMENTS

| | | | |
|---|---|---|---|
| D. 188,038 | 5/1960 | Dassler . | |
| D. 255,171 | 6/1980 | Bowers . | |
| D. 265,144 | 6/1982 | Vermonet . | |
| 1,573,299 | 2/1926 | Bullock | 36/114 |
| 2,165,879 | 7/1939 | Wilkinson . | |
| 2,531,763 | 11/1950 | Andre . | |
| 2,563,763 | 8/1951 | Vietas | 36/89 |
| 2,942,359 | 6/1960 | Bushway et al. . | |
| 3,545,107 | 12/1970 | Cinquegrana et al. . | |
| 4,204,346 | 5/1980 | Fugere | 36/114 |
| 4,366,634 | 1/1983 | Giese et al. | 36/114 |

FOREIGN PATENT DOCUMENTS

| | | | |
|---|---|---|---|
| 2606800 | 8/1977 | Fed. Rep. of Germany | 36/89 |
| 58-46643 | 10/1983 | Japan . | |

OTHER PUBLICATIONS

PCT WO83/03338, 10/1983, Norton et al.
PCT WO82/03754, 11/1982, Tilles.

*Primary Examiner*—Werner H. Schroeder
*Assistant Examiner*—Steven N. Meyers
*Attorney, Agent, or Firm*—Pennie & Edmonds

[57] ABSTRACT

An athletic shoe for runners, joggers, and the like includes a backtab at the upper heel/counter portion of the shoe which extends somewhat along both the lateral and medial sides of the shoe. The backtab is characterized as a cushioning member and it includes a cut-out or notch to accommodate the Achilles tendon of the foot to reduce or substantially eliminate stress and pressure on the Achilles tendon which may result in aggravation or injury to the tendon.

4 Claims, 3 Drawing Figures

CONSTRUCTION OF UPPER FOR ATHLETIC SHOE

DESCRIPTION

1. Technical Field

The invention relates to an athletic shoe which particularly may be of the type used by runners, joggers and the like having an improved construction of upper within the region of the heel.

2. Background of the Invention

There have been attempts over the years to produce an athletic shoe having improvements in the construction of the sole unit or the upper or in a combination of these structures to impart to the shoe, among other features, a greater stability and comfort to the wearer. Certain of these concepts are directed to a question of comfort to the wearer in relief from the shoe rubbing, chafing or cutting into the skin and the Achilles tendon at a point where the tendon is more or less exposed.

G. F. Bushway et al U.S. Pat. No. 2,942,359 discloses an athletic shoe of the type having an upper which embraces the region of the foot above the ankles and includes a support member which extends from each ankle, around the heel for protection of these portions of the foot against chafing and irritation. V. E. Cinquegrana et al U.S. Pat. No. 3,545,107 discloses a shoe construction having general similarity to the shoe construction of Bushway et al. H. Bullock, U.S. Pat. No. 1,573,299 on the other hand, discloses a shoe construction of so-called high top variety having an edge of the upper formed with a cut-out portion or notch. The cut-out or notch is located with respect to the Achilles tendon at a point at which the tendon is more or less exposed. According to Bullock the cut-out or notch may have any desired width, depth or overall shape. C. Vermonet U.S. Pat. No. Des. 265,144 discloses a shoe construction of so-called low cut variety having a cut-out or notch somewhat similar to the cut-out or notch of Bullock. In both Bullock and Vermonet the cut-out or notch appears to be formed in or immediately above either a backstay or counter of the ply of the upper. Neither reference includes a cut-out or notch in a backtab formed as a cushion element to provide further protection for the foot and further relief from the shoe rubbing, chafing or cutting into the skin and Achilles tendon at the point and within the region where the tendon is more or less exposed.

SUMMARY OF THE INVENTION

The invention relates to an athletic shoe (hereafter "shoe") which is considered an improvement over shoe construction as depicted by the prior art Bullock and Vermonet patents, among possible others. To this end, the shoe of the invention includes a sole unit and a shoe upper wherein the quarter portions and the upper heel portion are raised to a level very close to the ankle bones to provide increased support along both the lateral and medial sides of the foot. In an important aspect of the invention, a backtab including a cut-out or notch region within an otherwise cushioned construction is located at the upper heel of the shoe to extend around the heel toward each ankle. The backtab includes an inner lamina of a cushioning material, such as a high density foam, which protects and supports the foot, and together with the cut-out or notch provides relief from the shoe rubbing, chafing or cutting into the skin and Achilles tendon within the region at which the tendon is more or less exposed.

In a preferred form of the invention, the backtab comprises an inner and outer layer of sheet material, and an intermediate cushioning layer of a polyurethane foam. The inner and outer layers of sheet material are formed with a recess along an upper marginal edge, and when the inner and outer layers are sewn or otherwise united along that edge the recesses form the cut-out or notch. The inner and outer layers encase the intermediate cushioning layer along the upper marginal edge and the inner and outer layers may be sewn or otherwise united to the shoe upper along the remaining marginal edge in mounting the backtab to the shoe upper.

Other aspects and advantages of the invention will become apparent as the description to be read in conjunction with the accompanying Figures of drawing continues.

BEST MODE FOR CARRYING OUT THE INVENTION

Figure 1:
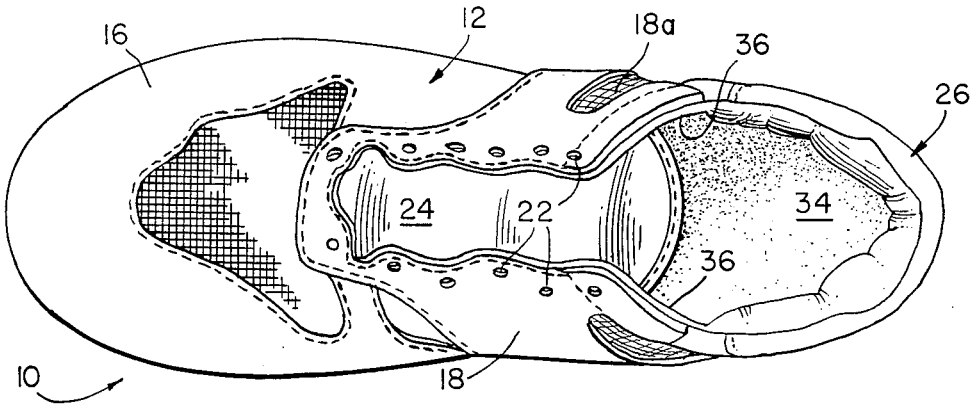
FIG. 1 is a plan view of the athletic shoe of the invention.
Figure 2:
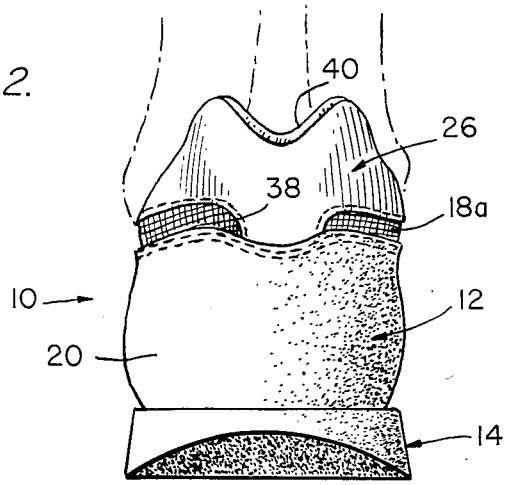
FIG. 2 is a rear view of the athletic shoe illustrating the upper heel construction.

The shoe 10 as illustrated in FIGS. 1 and 2 is formed by a lasted upper 12 and a sole unit 14. A shoe of the invention preferably is a shoe of so-called low-cut variety, although not limited thereto, as typically may be used by runners, joggers and the like.

The upper generally is formed by a vamp portion 16, a quarter portion 18 providing a foot receiving opening and a heel/counter portion 20. A series of eyelets 22 are located within a saddle having a somewhat extended length to secure the shoe on the foot as well as to support the arch and allow individual tension and instep adjustment. Securement of the shoe on the foot will be carried out by a lacing (not shown). A tongue 24 located below the eyelets extends from the vamp to assist both in support and cushioning of the instep of the foot when the shoe is worn.

By and large, the structural make-up and the materials forming both of the upper and the sole unit, and the manner of supporting the sole unit on the upper may be considered conventional To this end, referring to FIGS. 1 and 2, the quarter portion of the upper including the saddle may be formed of leather, pigskin or similar material. The quarter portion is supported throughout by a base material. The base material may be of two-ply construction including a soft, cotton inner ply (toward the interior of the shoe) and a nylon mesh ply 18*a* which is exposed to the exterior of the shoe within the region of the upper quarter and around the heel. The base material including the nylon mesh is designed for high strength and breathability. As to the sole unit 14, it may include both a midsole and an outsole as generally illustrated in FIG. 2. In contrast to a shoe of otherwise conventional character, the shoe of the invention is one that includes quarter portions and an upper heel portion which are increased in rise somewhat to a level very close to the region of the ankle bone of the foot. The intention is to provide a shoe with increased support along both the lateral and medial sides, and around the heel of the foot. In addition, a backtab 26 supported at the upper heel and around the heel toward each ankle provides cushioning relief and protection for the foot. The backtab is seen perhaps to best advantage in FIG. 2, and the parts forming the backtab may be seen in FIG. 3. The more important features of the backtab will be discussed below.

Backtab 26 includes inner and outer layers 28, 30 (referring to the inside and outside of the shoe) of a sheet material and an intermediate layer 32 of a cushioning material. The sheet material such as vinyl sheet provides an inner and outer surface cover for the intermediate layer which may be formed of high density polyurethane foam. The intermediate layer may be about 10–15 mm in thickness, or possibly of even greater thickness as determined by manufacturing and wear considerations.

The inner layer 28 is of an overall size larger (in the lateral and medial directions) than that of the outer layer 30. The extending portions of the inner layer are indicated as 28*a*, 28*b*. The inner layer, also, includes an extending portion 28*c*. The intermediate layer 32 is configured substantially like that of the outer layer, and the intermediate layer is of an overall size at least equal to that of the outer layer. Preferably, however, the intermediate layer will extend in the direction of the lateral and medial sides of the shoe throughout a slightly greater length, and the intermediate layer will extend throughout a somewhat greater distance toward the lower heel/counter portion 20 to increase the area of cushioning.

In the overall manufacture, the intermediate layer 32 may be adhered to the vinyl sheet forming the inner layer 28. An adhesive medium as may be conventional is used for this purpose. The inner and outer layers, then, may be secured together along their coextensive upper length, for example, by sewing, to provide an upper boundary for the intermediate layer. The inner layer 28 and the intermediate 32 are supported along the inner ply of the base material of the heel/counter portion 20 in position that the extensions 28*a*, 28*b* locate to the region of the saddle, within the region of the eyelets at the upper instep. The extending portion 28*c* will locate to the region of the lower heel/counter, adjacent the insole 34. The extensions 28*a*, 28*b* may be doubled over along their free length to form a ribbing 36 along the length of quarter portion 18 toward the outer layer 30 of backtab 26. The outer layer of the backtab will overlie the outer ply 18*a* of the base material of the quarter portion and both the inner and outer layers, including the free length of the inner layer, are sewed to the leather or pigskin material and/or the base material forming the quarter portion. A line of sewing 38 may be seen along the lower portion of the backtab. It may be that the outer layer is sewed to the upper, as a first step, and, then, the inner layer is sewed to the upper. The line of sewing will follow the free marginal edge of each layer. Thereafter, the heel/counter portion is similarly received on the base material to partially cover a portion of the outer layer 30 of the backtab 26.

Figure 3:
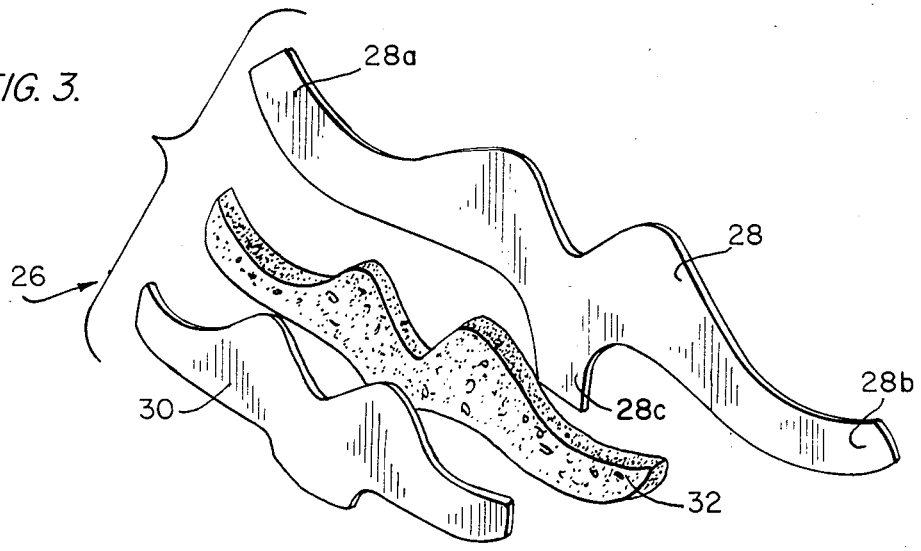
FIG. 3 is a perspective view of the elemental structural portions of the upper heel construction.

Backtab 26 includes a notch 40 which may be seen in FIGS. 2 and 3. As is clear from the Figures the backtab 26 generally is in the area of the rear of the foot to enclose the Achilles tendon, while the notch provides an area in the backtab which accommodates the tendon. The notch, therefore, provides the important function of eliminating or substantially reducing stress and pressure on the Achilles tendon during the gait cycle of the runner and the risk of aggravation from the shoe construction whose upper quarter and backstay are raised toward the ankle for increased support of the foot. By a choice of thickness and density of the foam material it is possible to vary the characteristics of cushioning and stability, among possible others, and by variation in the size of notch 40 it is possible to accommodate the shoe to foot structures as are normal for individual sizes.

I claim:

1. Footwear for runners and the like including a sole, an upper received on said sole extending from said sole within each quarter portion and upper heel to a height below yet closely adjacent the ankle bone on each of the medial and lateral sides for increased support of the foot along said sides and around said heel, and a backtab providing an extension of said upper and supported by said quarter portions and upper heel around the heel toward each ankle bone, said backtab comprising inner and outer layers of sheet material and futher characterized by a body located between said inner and outer layers and supported by said layers formed solely of cushioning material, said body providing cushioning and stability to the foot of the wearer within the upper heel region over the Achilles tendon, and a notched area along an upper, rear marginal edge of said backtab to accommodate said Achilles tendon and reduce stress during the gait cycle of the foot of the wearer as otherwise may be occasioned by providing said extension of said upper in increasing support of the foot.

2. The footwear of claim 1 wherein said inner and outer sheet material layers, each formed of a vinyl, provide, at least in part, a surface covering for said cushioning material when said backtab is mounted on said upper, and wherein said cushioning material is formed of polyurethane.

3. The footwear of claim 2 wherein said cushioning material is formed of high density polyurethane having a thickness of at least about 10 mm.

4. The footwear of claim 1 wherein said backtab extends throughout a substantial distance along both the lateral and medial sides of the upper toward a series of eyelets for use in mounting the footwear for use.

* * * * *